US011111718B2

(12) United States Patent
Warr

(10) Patent No.: US 11,111,718 B2
(45) Date of Patent: Sep. 7, 2021

(54) PEEP HOLE SECURITY SYSTEM AND METHOD

(71) Applicant: Garret M Warr, Oak Park, IL (US)

(72) Inventor: Garret M Warr, Oak Park, IL (US)

( * ) Notice: Subject to any disclaimer, the term of this patent is extended or adjusted under 35 U.S.C. 154(b) by 0 days.

(21) Appl. No.: 15/472,817

(22) Filed: Mar. 29, 2017

(65) Prior Publication Data

US 2017/0284152 A1 Oct. 5, 2017

Related U.S. Application Data

(60) Provisional application No. 62/314,989, filed on Mar. 29, 2016.

(51) Int. Cl.
*E06B 7/30* (2006.01)
*E06B 7/00* (2006.01)

(52) U.S. Cl.
CPC . *E06B 7/30* (2013.01); *E06B 7/00* (2013.01)

(58) Field of Classification Search
CPC ..... E06B 7/00; E06B 7/28; E06B 7/30; F16B 33/00; F16B 33/02; F16B 35/041; Y10T 29/49948
USPC ..... 411/366.1, 366.2
See application file for complete search history.

(56) References Cited

U.S. PATENT DOCUMENTS 2,348,589 A * 5/1944 Auten ..... F16B 37/145 411/15
4,251,127 A * 2/1981 Yamaguchi ..... E06B 7/30 359/504
4,269,474 A * 5/1981 Kamimura ..... G02B 25/04 359/504
5,244,326 A * 9/1993 Henriksen ..... F16B 37/145 411/180
2010/0259618 A1* 10/2010 Chen ..... H04N 7/186 348/151
2013/0108392 A1* 5/2013 Henriksen, Jr. ..... F16B 33/002 411/166

* cited by examiner

*Primary Examiner* — Roberta S Delisle
(74) *Attorney, Agent, or Firm* — Keeley DeAngelo LLP; W Scott Keeley

(57) ABSTRACT

Peep hole security systems and methods are provided including a threaded optical shaft having a bezel with a security pin extending from an interior surface of the bezel and a threaded interlocking cylinder including an interior flange. An optical shaft hole in a door receives the threaded optical shaft and a security pin hole in the door receives the security pin. The threaded optical shaft is then engaged with the threaded interlocking cylinder until the interior surface of the bezel contact the exterior surface of the door and the interior flange of the threaded interlocking cylinder contacts the interior surface of the door. Attempts to rotate the threaded optical shaft are prevented by the engagement of the security pin with the door.

14 Claims, 4 Drawing Sheets

PEEP HOLE SECURITY SYSTEM AND METHOD

CROSS-REFERENCE TO RELATED APPLICATIONS

The present application claims the benefit of U.S. Provisional Application No. 62/314,989, filed Mar. 29, 2016, entitled "SYSTEM AND METHOD FOR PEEP HOLE SECURITY", which is hereby incorporated by reference in its entirety.

BACKGROUND OF THE INVENTION

The present invention generally relates to a peep holes. More particularly, the present invention relates to security systems and methods for peep holes.

Current peep hole designs suffer from several drawbacks that may be exploited by the unscrupulous to obtain undesired optical intrusion into the interior of a room. For example, current peep hole bezels may typically be rotated from the exterior surface of the door. Unfortunately, when rotated, most peep holes may be removed from the door, which may allow an undesired party to see into the room.

Alternatively, optical devices exist that may be positioned over the bezel at the exterior of the peep hole, but will provide the unscrupulous user with an optically modified image so that the user may clearly see the interior of the room. In order to combat this, responsible hotels may install internal peep hole covers that optically block the peep hole. Unfortunately, such peep hole covers are typically attached to or responsive to the internal surface of the peep hole. Consequently, rotation and/or jiggling of the peep hole may cause the peep hole cover to become dislodged, which may then allow unscrupulous user to use an optical device to see into the room.

BRIEF SUMMARY OF THE INVENTION

One or more of the embodiments of the present invention provide peep hole security systems and methods. In one embodiment, a peep hole security system includes a threaded optical shaft including a cylindrical central shaft having an exterior thread and a bezel having an optical element. The bezel has an interior bezel surface with a security pin. The cylindrical central shaft and security pin are introduced into holes in the exterior portion of a door. A threaded interlocking cylinder including an interior thread and an interior flange is then provided. The interior thread of the threaded interlocking cylinder is then rotationally threaded into the exterior thread of the threaded optical shaft until the interior bezel surface is brought into contact with the exterior surface of the door and the interior flange is brought into contact with the interior surface of the door. Rotation of the threaded optical shaft is therefore prevented because attempts to rotate the threaded optical shaft cause the security pin to contact the interior of its hole and prevent rotation of the threaded optical shaft.

DETAILED DESCRIPTION OF THE INVENTION

Figure 1:
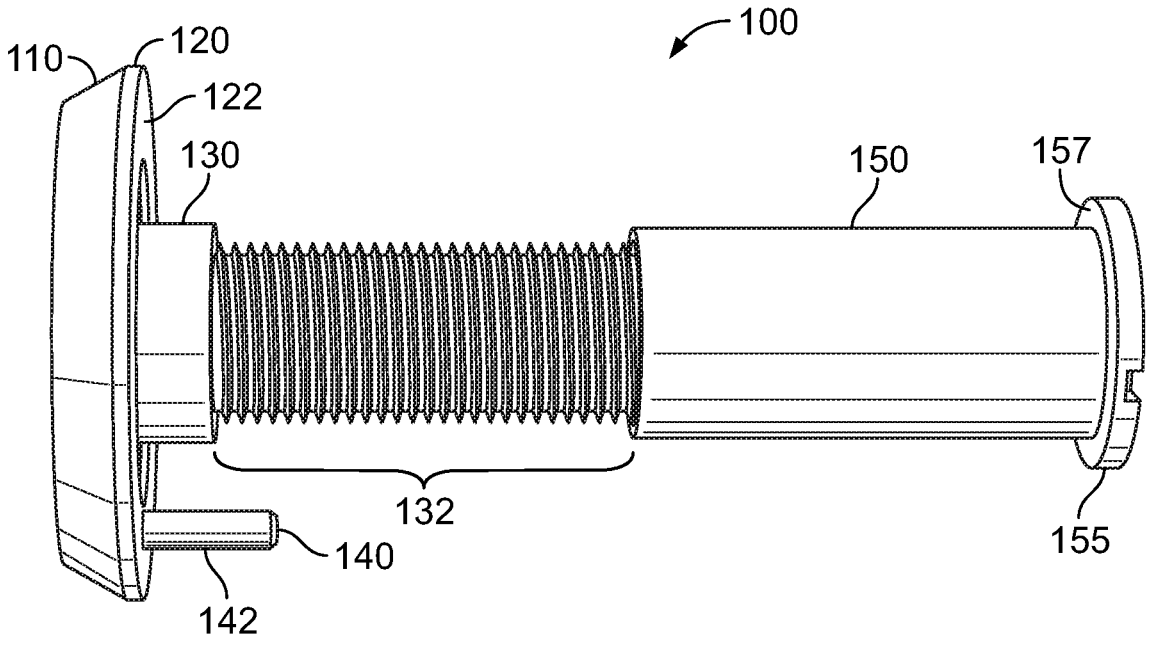
FIG. 1 illustrates a peep hole security system according to an embodiment of the present invention.

FIG. 1 illustrates a peep hole security system 100 according to an embodiment of the present invention. The peep hole security system 100 includes a threaded optical shaft 130 and a threaded interlocking cylinder 150. The threaded optical shaft 130 includes a bezel 110 having a flange 120 and an interior bezel surface 122, a security pin 140 having an exterior security pin surface 142, and an exterior thread 132 positioned on the central shaft of the threaded optical shaft. The threaded interlocking cylinder 150 includes an interior thread (not shown) and interior flange 155 having an interior flange surface 157. As shown in FIG. 1, the exterior thread 132 of the threaded optical shaft 130 has been partially threaded into the interior thread of the threaded interlocking cylinder 150 as further described below.

Additionally, the threaded optical shaft 130 and threaded interlocking cylinder 150 are generally cylindrical in shape and when threaded together form an optical pathway from an optical element (not shown) positioned at the exterior surface of the bezel 110 through the threaded optical shaft 130 and threaded interlocking cylinder 150 to an internal viewing aperture (not shown) formed by the interior flange 155.

Additionally, as shown in FIG. 1, the security pin 140 extends from the interior bezel surface 122 in the direction of the cylindrical central shaft of the threaded optical shaft 130. In one embodiment, the security pin 140 may be parallel to the cylindrical central shaft.

In operation, when the peep hole security system 100 is installed into a door, a main hole is drilled in through a door to accommodate the optical shaft 130. This hole may be referred to as the optical shaft hole. Further an additional, smaller drill hole that conforms to the size of the security pin 140 is drilled into the exterior surface of the door to accommodate the security pin 140. The optical shaft 130 is then introduced into the optical shaft hole in the door and the security pin 140 is introduced into the smaller drill hole, which may be called the security pin hole. The optical shaft 130 and security pin 140 are induced into their respective holes until the interior bezel surface 122 of the bezel 110 comes into contact with the outer surface of the door.

Once the optical shaft 130 and the security pin 140 are installed into their respective holes, rotational movement of the peep hole security system is constrained. More specifically, if a person attempts to rotate the bezel 110, the exterior security pin surface 142 is quickly brought into contact with the interior surface of the security pin hole and rotational motion of the bezel 110 is prevented.

To complete the installation of the peep hole security system 100 in the door, the interior thread of the threaded interlocking cylinder 150 is then rotationally threaded onto the exterior thread 132 of the threaded optical shaft 130 until the interior flange surface 157 of the interior flange 155 comes into contact with the interior surface of the door.

Once the interior flange surface 157 of the interior flange 155 comes into contact with the interior surface of the door and the interior bezel surface 122 of the bezel 110 is in contact with the outer surface of the door, further rotational threading is prevented, thus restraining further tightening.

Figure 2:
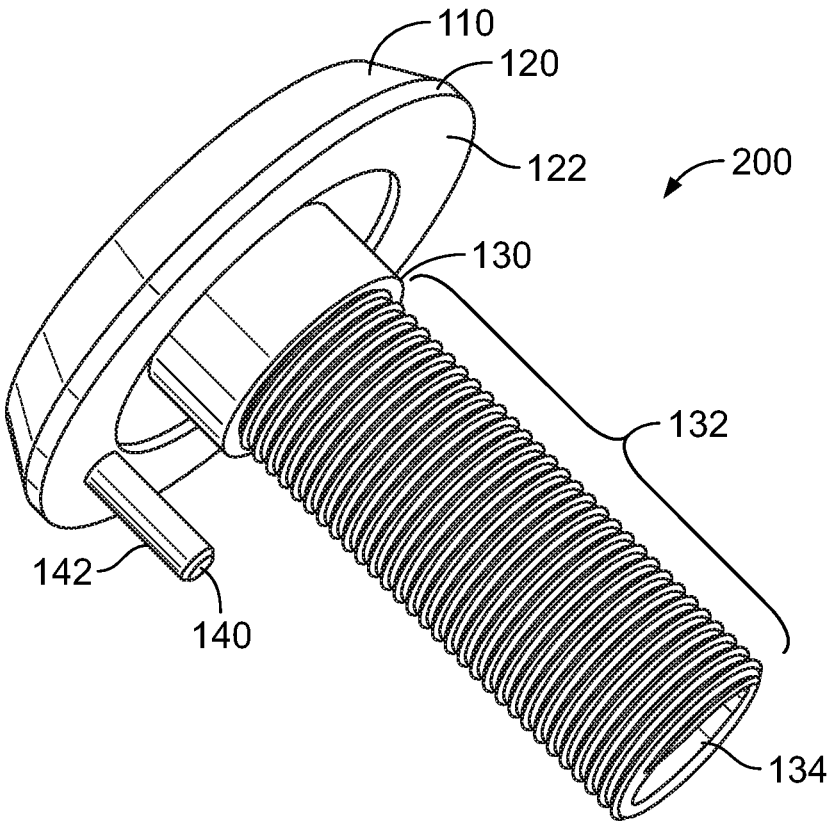
FIG. 2 illustrates a perspective view from the interior side of the threaded optical shaft.

FIG. 2 illustrates a perspective view 200 from the interior side of the threaded optical shaft 130. FIG. 2 also shows the bezel 110, flange 120, interior bezel surface 122, security pin 140, exterior security pin surface 142, and exterior thread 132. As discussed above, in operation the exterior thread 132 of the threaded optical shaft 130 is threaded into the interior thread of the threaded interlocking cylinder 150. Light passes through the threaded optical shaft 130 from an optical element (as shown in FIG. 4) positioned in the exterior surface of the bezel 110 and exits the threaded optical shaft 130 at the threaded optical shaft optical pathway exit aperture 134.

Figure 3:
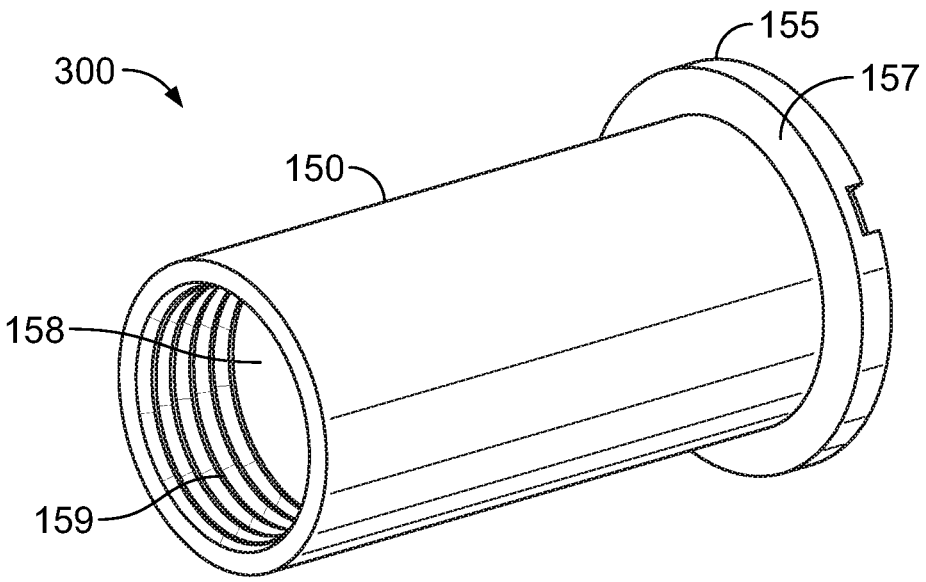
FIG. 3 illustrates a perspective view of the interior side of the threaded interlocking cylinder.

FIG. 3 illustrates a perspective view 300 of the interior side of the threaded interlocking cylinder 150. FIG. 3 shows the interior flange 155 and interior flange surface 157. Additionally, FIG. 3 shows the interior thread 159 of the threaded interlocking cylinder.

Also, as discussed above, in operation the exterior thread 132 of the threaded optical shaft 130 is threaded into the interior thread of the threaded interlocking cylinder 150. Light passes through the threaded optical shaft 130 from an optical element (as shown in FIG. 4) positioned in the exterior surface of the bezel 110 and exits the threaded optical shaft 130 at the threaded optical shaft optical pathway exit aperture 134 and then in turn enters the threaded interlocking cylinder optical pathway entrance aperture 158 of the threaded interlocking cylinder 150. The light then passes though the threaded interlocking cylinder 150 to an internal viewing aperture (not shown) formed by the interior surface of the interior flange 155.

Figure 4:
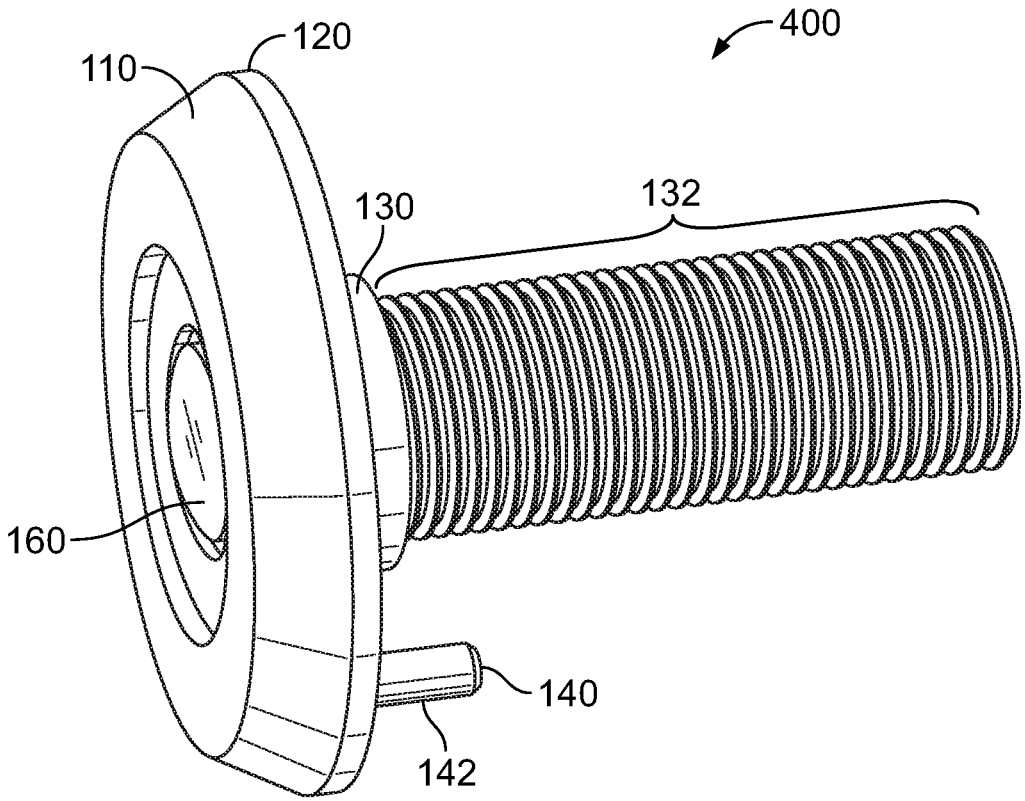
FIG. 4 illustrates a perspective view from the exterior side of the threaded optical shaft.

FIG. 4 illustrates a perspective view 400 from the exterior side of the threaded optical shaft 130. FIG. 4 also shows the bezel 110, flange 120, security pin 140, exterior security pin surface 142, and exterior thread 132. Additionally, FIG. 4 shows the optical element 160 positioned at the exterior surface of the optical pathway through the peep hole security system 100.

Figure 5:
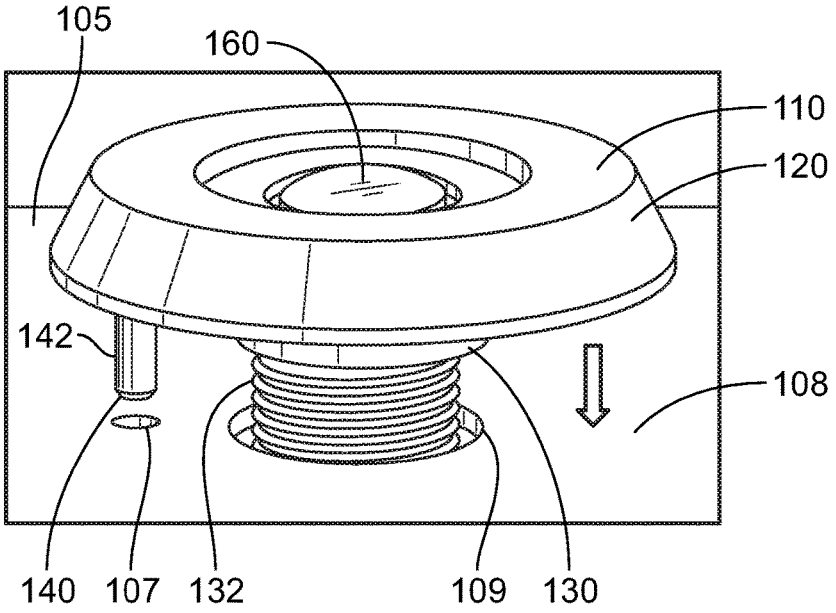
FIG. 5 illustrates the threaded optical shaft of the peep hole security system during installation into a door.

FIG. 5 illustrates the threaded optical shaft 130 of the peep hole security system 100 during installation into a door 105. As shown in FIG. 5, the door 105 includes an optical shaft hole 109, outer door surface 108, and a security pin hole 107. Additionally, the optical element 160, bezel, 110, flange 120, exterior thread 132, security pin 140, and exterior security pin surface 142 are also shown.

As shown in FIG. 5, the threaded optical shaft 130 as been introduced into the optical shaft hole 109 and the security pin 140 is being introduced into the security pin hole 107. Next, the threaded optical shaft 130 and security pin 140 are further engaged with their respective holes 109, 107 until the interior bezel surface 122 (not shown) comes into contact with the outer door surface 180 of the door 105.

As discussed above, to complete installation of the peep hole security system, the interior thread 159 of the threaded interlocking cylinder 150 is threaded into the exterior thread 132 of the threaded optical shaft 130 and rotationally threaded until the interior flange 155 of the interlocking cylinder 150 is brought into contact with the interior surface of the door 105.

In one embodiment, when installed, the interior bezel surface 122, may be in contact with, abutting, and/or positioned proximal to the outer door surface 108. Similarly, in one embodiment, when installed, the interior flange surface 157 may be in contact with, abutting, and/or positioned proximal to the inner door surface.

In one embodiment, the security pin hole 107 only extends into the exterior surface of the door a sufficient distance to accommodate the height of the security pin. In another embodiment, the security pin hole 107 may extend through the door.

In the embodiment shown in the figures above, the security pin 140 was circular in cross-section. However, in other embodiments, the security pin may be square, triangular, or hexagonal or octagonal.

One additional feature of the peep hole security system 100 is that it is tamper evident. For example, in some cases, pranksters or malicious persons who have access to the interior of a hotel room may unscrew and/or remove a peep hole from the inside of the hotel room and then re-install the peep hole backwards. Unless corrected or otherwise blocked, the peep hole may then allow someone outside the door to directly look into the interior of the hotel room without even requiring the assistance of an optical device.

However, with peep hole security system 100 shown in FIG. 1, even if a malicious person inside a hotel room removes the peep hole and attempts to re-install the peep hold backwards, the security pin 140 will come into contact with the interior surface of the door (there is no security pin hole on the interior surface of the door for the security pin to enter) and prevent the interior bezel surface 122 from coming into contact with the interior surface of the door. Thus, the bezel 110 will protrude from the interior surface of the door by a distance equal to the height of the security pin 140.

The protrusion of the bezel 110 thus serves as tamper evidence that is readily recognizable by a subsequent user of the hotel. The protruding bezel 110 looks very strange and is immediately recognized by users that something is wrong with the peephole.

One advantage provided by the present peep hole security system 100 is that because the security pin 140 engages with the exterior surface of the door, if a person outside the door attempts to rotate the bezel 110, the edges of the security pin 140 will engage with the surface and/or interior of the door and prevent the bezel 110 from being rotated, thus locking the bezel in place.

This represents a considerable improvement in current peep hole technology because current peep hole bezels may typically be rotated from the exterior surface of the door. Unfortunately, when rotated, most peep holes may either be removed from the door, which may allow an adverse party to see into the room, or the rotation of the bezel may cause an internal peep hole cover to be dislodged, which may allow an adverse party having certain optical devices to see into the interior of the room. Fortunately, the present peep hole security system 100 can counteract this security flaw by preventing the rotation of the bezel from outside the room.

In one embodiment, the pin or other part of the design may be tapped and/or bonded, for example, by being of tempered alloy, it may allow the economy of casting, while achieving much of the strength of a forged and tempered steel, which is an alternative design. Additionally, one or more components of the design may be made of plastic or other rigid material.

In one embodiment, the pin may be welded or brazed. Alternatively, one or more portions of the design may be casted or machined. In one example, one or more portions of the design may be machined from a forged billet.

In one embodiment, a tapped and/or threaded hole is placed on the back of the peephole bezel, and with a hole bored through the door to meet it, a bolt threaded through the door from the inside and tightened into the tapped and threaded hole located on the back of the peephole's exterior bezel.

In one embodiment, a greater number of pins, such as two, three, or four pins may be used in place of the single pin.

In one embodiment, the interlocking peephole and door relationship allows them to be mated/nested from one side and remain free of manipulation/rotation from one side after installation. Though still removable when required, provided there is access from the authorized side.

In one embodiment, for the threading of nut, or sleeve or bolt from a single opposite planar side—where it may then still be tightened with the desired threaded sleeve, or nut—with no further application of mechanical force being needed on the interlocking flange side of the door. A one person install, or easier install with less time and effort needed to isolate the other side with application of an opposing mechanical force.

Thus, in one embodiment, because the pin prevents the rotation of the peep hole once it has been introduced into the door, it becomes easier to thread the locking sleeve onto the exterior of the optical shaft from the inside of the door because it is no longer necessary to simultaneously hold the exterior bezel while threading the locking sleeve. Consequently, it may be easy to install, installation may proceed faster, installation may require fewer hands, and/or installation may require fewer resources.

And with less application of force less than what would effectively break the components—being in any way practical to apply—the present design provides a security feature. Additionally, one or more embodiments may provide isolation from vibration, movement, and human tampering from that side as well as easier maintenance, as only a single side must be checked or retorqued.

Additionally one or more embodiments may provide a secure feature that unlike welding, is not material substrate and alloy compatibility dependent, nor is it destructive or overly intensive/invasive for authorized installation/maintenance removal upgrade and is not destructive or difficult to perform the same, compared to an adhesive/epoxy and boasts better mechanical advantage/strength.

Also, one or more embodiments may provide an aesthetic benefit including stealth/clean assembly with hidden fasteners. Also, only the opposite side remains free to turn, to either tighten or loosen the assembly. As the peephole's bezel completely hides the fasteners in the flange which isolate the flange from movement. This solves concerns of tampering from the unsecure side of the component (door). As with the compressive force of the assembly tightly mating the (door) and component with an interlocking bias coordinate that is separate and distinct in location—additional to the equidistant coordinate of the shared threaded shaft which interlocks with the door. Further, one embodiment may be used in metal applications—including applications other than doors.

In one embodiment there is an alternative to welding for there to be reduced input heat into the assembly or part—and reduction of the HAZ that is of concern with weakening and warping metals or removing tempering (T6-6061 AL for example) or the 2000 series of AL alloys in aeronautics that are notoriously problematic for welding.

One embodiment provides an alternative to traditional bolt and nut assembly: easier installation and security from tampering or vibration.

One or more embodiments may provide one or more of the following advantages.

One or more embodiments may allow design of a tight/limited space assembly. Where a design has to address or imposes space restraints in a mechanical assembly—where it might only allow a tool wielding operator to access one side but not the other.

One or more embodiments may be used where currently they might otherwise currently rely upon a costly manufacturing application of a threaded tap to machine a thread into the part, so it allows access from one side to torque and thereby eliminating requirement for access to the other side of the component during assembly and repair:

One or more embodiments may be improved upon by more strength with bolt through diffusion of mechanical force applied/required to endure—instead of reliance upon the narrower diffusion of force in a partially tapped assembly.

One or more embodiments may be provided at less manufacturing cost, being only 2 holes instead of tapped and machined threads, and a mass produced part inserted likely held in place during assembly with a light duty/temporary adhesive.

One or more embodiments may resist galvanic corrosion: for example where currently there is often an instance of a steel bolt being threaded into a tapped and threaded hole in an aluminum pump or engine block—the threads seize, corrode from galvanic corrosion of dissimilar alloys, then bolts break off—requiring expensive specialty boring and retapping and alternate bolts be made for appropriate application—increasing downtime, and maintenance costs.

One or more embodiments may avoid the aluminum threads which are also much weaker than steel, and there are creep factors with thermal cycling, particularly in dissimilar materials that as weak points downgrade the effective longevity and capacities of a system to elements and time, heat soak, stress hardening, and shock.

One or more embodiments may provide a one piece iteration of this insert and collar with pin (like the peephole side with its pin) may be formed around a steel barrel with internal threads and efficiently mass produced in varying sizes—like most fasteners are and, like nuts and bolts, may be mass produced.

One or more embodiments may have Carbon fiber translating mechanical force between dissimilar alloys, with the above mentioned bolt through advantage of greater footprint diffusing force over more material—while acting as an intermediary between direct contact, like a galvanic coupling, keeping the contact between Steel and Aluminum separate.

One or more embodiments may allow the continued application of Steel to Steel threading for mechanical strength and thereby raising the effective temperature ranges, and retained compressive strengths at those thresholds the bonded assembly has against creep and catastrophic failure. This may be done elsewhere to for caustic service resistance, for example, by allowing more flexibility in materials chosen.

One or more embodiments may be used at higher pressures, higher temperature ranges, and provide higher longevity.

For one or more embodiments, when the system fails, the same bolt, and size may be used. In this case, the old one is pushed out of the holes, and a new assembly is put in its place, so less maintenance, and when and if required, easier and cheaper to deal with than a snapped bolt in a tapped and threaded hole.

One or more embodiments lowers lifetime cost of maintenance and reduced downtime, while allowing more robust engineering and capabilities in machines.

One or more embodiments provides an interlocking flange/backplate/security collar screwed to door.

In other embodiments, a circular (shape is aesthetically preferred for reduced door footprint, but the bezel and/or flange may be of any shape, such as ovoid, square, rectilinear, or trapezoidal. Economics of manufacturing also prefer less mass, but not exclusive to working to provide the security/one way aspect of bolt mechanism) flange that is the same or only slightly larger diameter than the back of the peephole.

In one or more embodiments, the flange is recessed with a recessed embossing or negative imprint and the peephole back is the positive nested coordinates. Or the inverse—so long as the two components are Interlocking. Which can be a 3d cavity of any 2d shape whose entirety of planar points are not equidistant to a single point, such as a star of any point, an oval, square, any matter of polygon etc. It is also acknowledged that while a circle can circumscribe any shape—the shape which it circumscribes—no matter how affinitive, is not comprised exclusively of planer points that are not equidistant. Additionally, shapes other than a circle, such as a triangle or polygon or star or square may be employed. Additionally, several circles or shapes that are recessed into the flange may also be employed.

One or more embodiments the flange has a hole in the center to allow a peephole tube to pass through, and two or more countersunk holes that allow screws or bolts (threaded fasteners) of matching shoulder pitch to secure to surface on which it is installed, while remaining flush, or lower than the flange's highest point or maximum standoff. The peephole is then placed through the hole of the flange and the component (door for this iteration) that the flange has been installed on. The interlocking surfaces are mated/nested and then the other side can be tightened with the desired threaded sleeve, or nut—with no further application of mechanical force being needed on the interlocking flange side of the door to prevent rotation due to the engagement of the pin with the door. And with no application of force less than what would effectively break the component being practical to apply, which is a security feature. Further, the embodiment provides isolation from vibration, movement, and human tampering from that side, as well as an aesthetic benefit such as a stealth/clean assembly with hidden fasteners. Only the opposite side remains free to turn, to either tighten or loosen the assembly. As the peephole's bezel completely hides the fasteners in the flange which isolate the flange from movement.

Assuming the planar surface of install was vertical, such as a door (y axis), (whose thickness would then be x-axis) the assembly may first be removed from the opposite side of Door Y, to reduce the compressive force mating the interlocking assemblies, until at least which time as there is enough play/or movement of threaded shaft's length (x-axis), of the bolted assembly to allow the assemblies to be separated off/out of one another—which only then assembly be turned manipulated/unthreaded from the flange side.

One or more embodiments the flange may be bonded with fusion or welding or adhesives or compressed depending on the compatibility and end use of the materials to allow mass assembly without the cost of holes and screws.

One or more embodiments allow a simple install; without need of jig or measuring to place bore hole for pin. As the flange places the pins (screws or bolts, even nails) in the correct location. Additionally, one or more embodiments may use a cast assembly for peephole, and a stamped or formed, possibly even machined flange, or both components being cast may be cheaper than bonding a tempered pin into a part.

Figure 6:
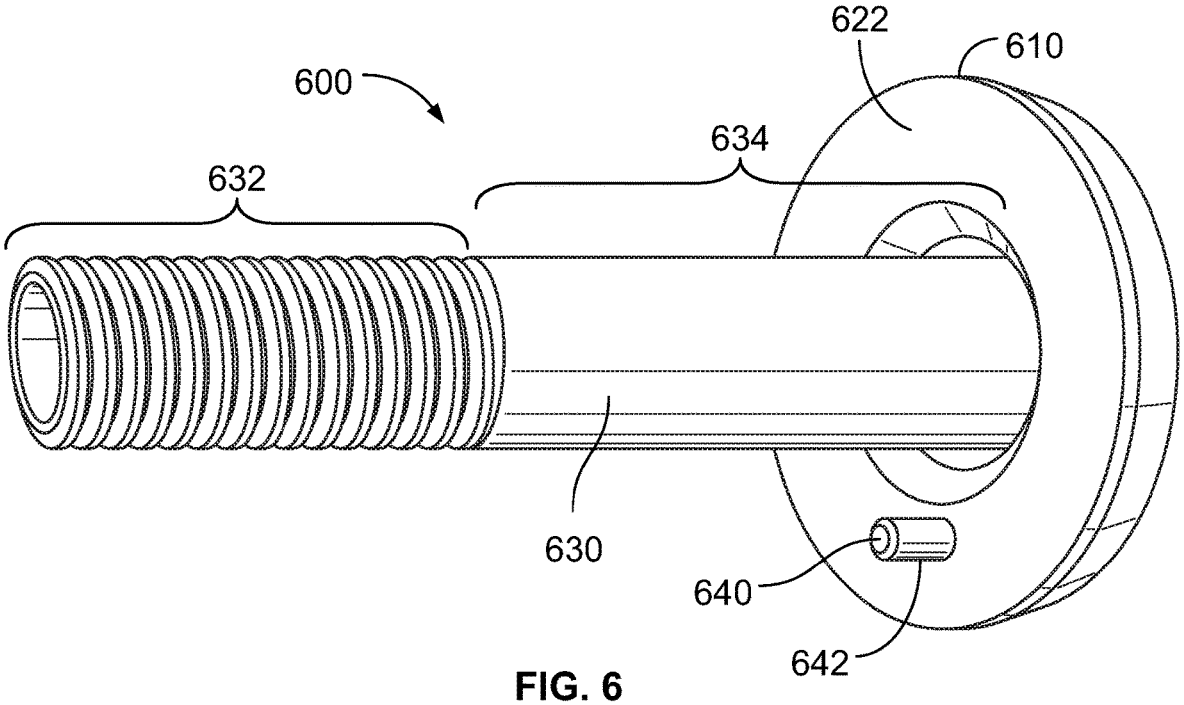
FIG. 6 illustrates an alternative embodiment of a bolt security system including a security bolt having a security pin.

FIG. 6 illustrates an alternative embodiment of a bolt security system 600 including a security bolt 630 having a security pin 640. The bolt 630 includes a bolt head 610, an interior bolt head surface 622, a central shaft threaded portion 632 and a central shaft non-threaded portion 634. The security pin 640 has an exterior security pin surface 642.

In operation, the bolt security system 600 performs similarly to the peep hole security system 100 described above. For example, the bolt 630 may be positioned in a bolt hole extending through a surface and the security pin may be introduced into a pre-formed security pin hole in the exterior side of the surface. The bolt may then be tightened to the exterior side of the surface by rotationally threading a standard nut onto the central shaft threaded portion 632, much like the threaded interlocking cylinder 150 threads into the threaded optical shaft 130 of the peep hole security system 100. Tightening the nut brings the nut into contact with an interior side of the surface through which the bolt extends while also bringing the interior bolt head surface 622 into contact with the exterior side of the surface.

Additionally, as described above with regard to the peep hole security system 100, once the security pin is placed in the security pin hole in the exterior side of the surface and the nut is tightened, the bolt head 610 is not rotatable from the exterior side (bolt head side) of the surface. Attempts to rotate the bolt head 610 cause the exterior security pin surface 642 to contact the side of the security pin hole and prevents rotation.

Figure 7:
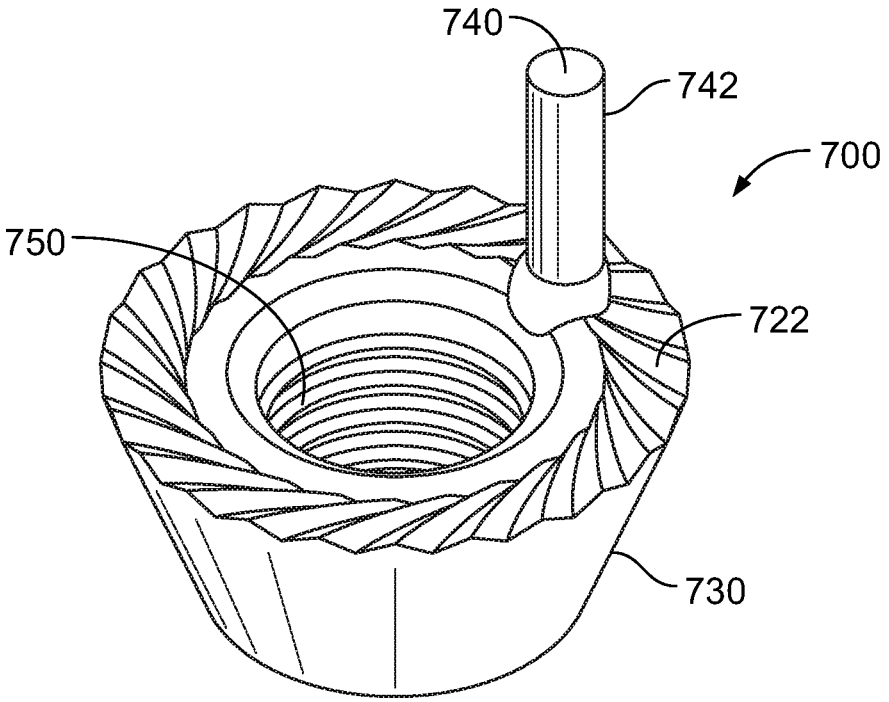
FIG. 7 illustrates an alternative embodiment of a nut security system including a security nut having a security pin.

FIG. 7 illustrates an alternative embodiment of a nut security system 700 including a security nut 730 having a security pin 740. The nut 730 has an interior nut head surface 722 and a nut threaded portion 750. The security pin 740 has an exterior security pin surface 742.

In operation, the nut security system 700 performs similarly to the peep hole security system 100 and bolt security system 600 described above. For example, a standard bolt may positioned in a bolt hole extending through a surface with the head of the bolt on an interior side (secure side) of the surface, which allows a nut to be threaded onto a threaded portion of the bolt that extents to an exterior side (unsecure or public side) of the surface. Additionally, on the exterior side of the surface a pre-formed security pin hole may be established.

The security pin 740 of the security nut 730 may be introduced into the security pin hole and then a standard bolt may be passed through a bolt hole in the surface so that the threaded portion of the bolt rotationally engages the threaded nut portion 750. Tightening the bolt brings the head of the bolt into contact with an interior side of the surface through which the bolt extends while also bringing the interior nut head surface 722 into contact with the exterior side of the surface.

Additionally, as described above with regard to the peep hole security system 100 and bolt security system 600, once the nut security pin is placed in the security pin hole in the surface and the bolt is tightened, the security nut 730 is not rotatable from the exterior side (nut side) of the surface. Attempts to rotate the security nut 730 cause the exterior security pin surface 742 to contact the side of the security pin hole and prevents rotation.

Both the security nut and security bolt embodiments include the addition of a security pin that may be introduced into a pre-formed hole in the surface to which the nut or bolt will abut in operation, much as described above with regard to the peep hole security system. This embodiment may represent an improvement on the lock washer so that a lock washer may no longer be needed. More specifically, a higher degree of isolation from rotation provided by fixing one set of threads with a locking pin into a component side in that the threads do not turn without the component they're pinned into being rotated. For example, the peephole's exterior fastener does not rotate once pinned into the door.

Additionally, other embodiments may be employed in applications where the lock washer may not be dependable enough to lock the thread's ability to rotate without the component they are mounted in rotating. For example, the threads being in an engine block prevents it from coming loose unless the bolt is reversed out with a tool, and a user need not hold a wrench on the other side to tighten or loosen a connection.

In one embodiment, static threads that are fixed in their orientation with the component may be pushed or inserted into place, allowing the use of different materials for the thread assembly than necessarily what the component's parent material is and may also provide the ability to replace the threading if they break.

For example, if a user were removing a valve cover on an operational engine or a turbine housing that is in the field, and installed and a bolt broke off, the user would have to pull the entire assembly and re-tap and thread for a larger bolt, or to maneuver a tapping die into confined space, often at awkward angles, and tap new threads. The other alternative is to have back up components with all their costly manufactured threads and machining on hand to replace it completely and scrap the old piece that is compromised now, with threads stripped, or bolts broken off inside threads.

However, if the threads were a female threaded tube, (or male threaded stud) with locking head or collar placed in a smooth bore hole—then damaged threads would only be a matter of pushing out the old thread assembly, and inserting a new (pre manufactured one) of the appropriate size. (Initial Machining of threads could also be done at a higher throughput rate, like a screw machine instead of a multi axis CNC (computer numerical control) having to reach around a component and position itself for each angle and tap cut threads into it.) Then it could be bolted back together.

In an engine or other automotive component, for example, many bolts or threaded bolt receiving ports may be employed and may be integral to the structure in which they are found. All of those bolts go into the assembly which is tapped, and if any one of those failure points fail: the entire component needs to be re machined to possibly salvage or scraped and replaced. Many times these large components are made of aluminum alloys to reduce weight, yet the bolts are steel. This reduces the pressure the threads can hold and the inability to keep all threaded components of steel, means this will suffer galvanic corrosion and ultimately fail.

Thus, in one embodiment, instead of needing to re-machine threads into components that had their threads cut directly into the substrate of the component at time of manufacture, the user may simply acquire and use another from a bin of interchangeable items, such as nuts are employed today. In this embodiment, the threads are already there, and the user does not have to machine any assemblies during the repair to complete it. Using standard interchangeable threads, instead of threads that are bored into, and machined out of the parent assembly. Thus the prior art is not fault-tolerant: a stripped thread, or frozen thread that breaks off, bent threads, rusted or oxidized threads, even at time of manufacture, and error in the casting or in the threading that does not achieve good threads requires the entire costly assembly needs machining repair or is wholly lost, and needs replacement. Conversely, in the new embodiment, if it's just a small interchangeable part that new insert may be placed and the component not only readily returned to original specs, but the damage may be isolated to a small part instead of the entire component.

Further problems with the prior art that increase the desirability of the present embodiment include the fact that prior art structures include studs such as those used in a turbine, that may be integral to the structure itself and extend outwardly from the structure. Such systems may still benefit from one or more of the present embodiments by not requiring access with a tool to the opposite side of the flange, for example, to keep the threads from rotating while tightening the nut, as described above with regard to the threaded stud like the peephole assembly, and passed through a hole in the flange, and the head had a pin locking into the flange. In this embodiment, if a stud is broken, the user may just hammer out the old one and insert a new one without the need for rethreading.

While particular elements, embodiments, and applications of the present invention have been shown and described, it is understood that the invention is not limited thereto because modifications may be made by those skilled in the art, particularly in light of the foregoing teaching. It is therefore contemplated by the appended claims to cover such modifications and incorporate those features which come within the spirit and scope of the invention.

The invention claimed is:

1. A peep hole security system including:

a threaded optical shaft including a cylindrical central shaft having an exterior thread and a bezel having an optical element, wherein a security pin extends from an interior bezel surface of said bezel in the direction of said cylindrical central shaft; and a threaded interlocking cylinder including an interior thread and an interior flange having an interior flange surface, wherein said cylindrical central shaft is introduced into an optical shaft hole that has been formed in a door, wherein said security pin is introduced into a security pin hole that has been formed in said door, wherein said security pin hole has a security pin hole interior surface, wherein said interior thread of said threaded interlocking cylinder is threaded into said exterior thread of said threaded optical shaft to bring said interior bezel surface into position proximal to an outer surface of said door and said interior flange into position proximal to an inner surface of said door, wherein attempts to rotate said threaded optical shaft cause said security pin to contact said security pin hole interior surface thus preventing rotation of said threaded optical shaft.

2. The system of claim 1 wherein the interior of said cylindrical central shaft describes an optical pathway from said optical element to a threaded optical shaft optical pathway exit aperture.

3. The system of claim 1 wherein the interior of said threaded interlocking cylinder describes an optical pathway from said a threaded interlocking cylinder optical pathway entrance aperture to said interior flange.

4. The system of claim 1 wherein said security pin is circular in cross section.

5. The system of claim 1 wherein said security pin is square in cross section.

6. The system of claim 1 wherein at least one of said interior bezel surface is in contact with said outer surface of said door and said interior flange is in contact with said inner surface of said door.

7. The system of claim 1 wherein at least one of said interior bezel surface abuts said outer surface of said door and said interior flange is abuts said inner surface of said door.

8. A peep hole security method including:

introducing a cylindrical central shaft of a threaded optical shaft into an optical shaft hole that has been formed in a door, wherein said cylindrical central shaft has an exterior thread, wherein said threaded optical shaft includes a bezel having an optical element, wherein a security pin extends from an interior bezel surface of said bezel in the direction of said cylindrical central shaft;

introducing said security pin into a security pin hole that has been formed in said door and includes a security pin hole interior surface;

threading said exterior thread into an interior thread of a threaded interlocking cylinder, wherein said threaded interlocking cylinder includes an interior flange having an interior flange surface; and continuing said threading to bring said interior bezel surface into position proximal to an outer surface of said door and said interior flange into position proximal to an inner surface of said door, wherein attempts to rotate said threaded optical shaft cause said security pin to contact said security pin hole interior surface thus preventing rotation of said threaded optical shaft.

9. The method of claim 8 wherein the interior of said cylindrical central shaft describes an optical pathway from said optical element to a threaded optical shaft optical pathway exit aperture.

10. The method of claim 8 wherein the interior of said threaded interlocking cylinder describes an optical pathway from said a threaded interlocking cylinder optical pathway entrance aperture to said interior flange.

11. The method of claim 8 wherein said security pin is circular in cross section.

12. The method of claim 8 wherein said security pin is square in cross section.

13. The method of claim 8 wherein said threading brings at least one of said interior bezel surface into contact with said outer surface of said door and said interior flange into contact with said inner surface of said door.

14. The method of claim 8 wherein said threading brings at least one of said interior bezel surface into abutment with said outer surface of said door and said interior flange into abutment with said inner surface of said door.

* * * * *